US006827415B2

(12) United States Patent
Otokita et al.

(10) Patent No.: US 6,827,415 B2
(45) Date of Patent: Dec. 7, 2004

(54) PRINTING APPARATUS, COMPUTER-READABLE MEDIUM, AND PRINTING METHOD

(75) Inventors: Kenji Otokita, Nagano-ken (JP); Hirokazu Nunokawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/443,146

(22) Filed: May 22, 2003

(65) Prior Publication Data

US 2004/0109035 A1 Jun. 10, 2004

(30) Foreign Application Priority Data

May 22, 2002 (JP) ..... 2002-148269

(51) Int. Cl.[7] ..... B41J 29/38; B41J 29/393
(52) U.S. Cl. ..... 347/14; 347/19
(58) Field of Search ..... 347/14, 19

(56) References Cited

U.S. PATENT DOCUMENTS 6,123,404 A * 9/2000 Tanaka et al. ..... 347/5
2004/0046810 A1 * 3/2004 Lapstun et al. ..... 347/7

* cited by examiner

*Primary Examiner*—Lamson Nguyen
*Assistant Examiner*—Alfred Dudding
(74) *Attorney, Agent, or Firm*—Sughrue Mion, PLLC

(57) ABSTRACT

A printing apparatus and so forth capable of performing prediction of a usage amount of a recording agent with respect to image data to be printed in a short amount of time is realized. A printing apparatus comprises a print head for performing printing using a recording agent, and a usage amount prediction section for predicting, before printing is performed at a predetermined resolution based on image data using said print head, a usage amount of the recording agent to be used for said printing, wherein, upon predicting the usage amount, the usage amount prediction section uses data based on the image data and having a resolution lower than said predetermined resolution.

11 Claims, 9 Drawing Sheets

| | | INK DENSITY (mg/inch$^2$) | INK DENSITY RATIO |
|---|---|---|---|
| PATTERN 1 | PRINT AT ORIGINAL DATA RESOLUTION (360dpi x 360dpi) | 10 | 1.5 |
| | PRINT AT PRINT-IMAGE RESOLUTION (1440dpi x 720dpi) | 15 | |
| PATTERN 2 | PRINT AT ORIGINAL DATA RESOLUTION (360dpi x 360dpi) | 15 | 1.8 |
| | PRINT AT PRINT-IMAGE RESOLUTION (1440dpi x 720dpi) | 27 | |
| PATTERN 3 | PRINT AT ORIGINAL DATA RESOLUTION (360dpi x 360dpi) | · | α3 |
| | PRINT AT PRINT-IMAGE RESOLUTION (1440dpi x 720dpi) | · | |
| PATTERN 4 | PRINT AT ORIGINAL DATA RESOLUTION (360dpi x 360dpi) | · | α4 |
| | PRINT AT PRINT-IMAGE RESOLUTION (1440dpi x 720dpi) | · | |
| PATTERN 5 | PRINT AT ORIGINAL DATA RESOLUTION (360dpi x 360dpi) | · | α5 |
| | PRINT AT PRINT-IMAGE RESOLUTION (1440dpi x 720dpi) | · | |
| PATTERN 6 | PRINT AT ORIGINAL DATA RESOLUTION (360dpi x 360dpi) | · | α6 |
| | PRINT AT PRINT-IMAGE RESOLUTION (1440dpi x 720dpi) | · | |

$$\text{INK DENSITY RATIO} = \frac{\text{INK DENSITY WHEN PRINTING AT PRINT-IMAGE RESOLUTION (1440dpi x 720dpi)}}{\text{INK DENSITY WHEN PRINTING AT ORIGINAL DATA RESOLUTION (360dpi x 360dpi)}}$$

$$\text{CONVERSION COEFFICIENT } (\alpha) = \frac{1.5 + 1.8 + \alpha 3 + \alpha 4 + \alpha 5 + \alpha 6}{6}$$

FIG. 7

PRINTING APPARATUS, COMPUTER-READABLE MEDIUM, AND PRINTING METHOD

CROSS-REFERENCE TO RELATED APPLICATIONS

The present application claims priority upon Japanese Patent Application No. 2002-148269 filed May 22, 2002, which is herein incorporated by reference.

BACKGROUND OF THE INVENTION

1. Field of the Invention

The present invention relates to a printing apparatus, a computer-readable medium, and a printing method. Specifically, the present invention relates to a printing apparatus for predicting the usage amount of recording agent used for printing before performing printing at a predetermined resolution based on image data using the recording agent.

2. Description of the Related Art

In a printing apparatus, a recording agent, such as ink and toner, used for printing is supplied from a container containing a predetermined amount of the agent. When the recording agent runs out because of repetitive printing, printing will be ended before completion of an image. In order to avoid waste of recording paper and/or recording agent, there is a printing apparatus that predicts, in advance, the amount of recording agent that will be used for printing, compares the amount with the remaining amount of recording agent, and determines whether or not it is possible to print.

Here, prediction of the recording agent to be used is made by first expanding input image data to be printed into print data that is just about to be used for printing, and then predicting the usage amount of recording agent used according to that print data.

Here, the print data used for usage amount prediction is generated as binary data necessary for depicting an image by supplying, to a printer driver 90*a*, image data (image signal that has been read) supplied from, for example, an application program under management of an OS (operating system), and using three basic means, i.e., the rasterizer, the color-correction module, and the halftone module, that the printer driver 90*a* comprises.

That is, the image data is divided into the three primary colors, i.e., R (red), G (green), and B (blue), by the rasterizer, and RGB bit image data in which rasterization has been performed for each color is obtained. The obtained RGB bit image data is converted so that its resolution matches the resolution for output with the printer. For example, if the image data is bit image data that has been read at a resolution of 360 dpi in both the main-scan direction and the sub-scan direction whereas the printer resolution is 720 dpi in both the main-scan direction and the sub-scan direction, a resolution conversion for generating data for interpolation between each data in the main-scan direction and the sub-scan direction of the image data is performed. The resolution-converted RGB bit image data is subjected to a color-correction process by the color-correction module in order to make the data match the colors for printing, and is converted into CMYK bit image data for printing in K (black), C (cyan), M (magenta), and Y (yellow). Further, after dividing C and M of the CMYK bit image data into C, c and M, m using a dark/light ink division table, a halftone process according to, for example, the dither method or the error diffusion method is performed by the halftone module. In this way, arrangement on a bitmap, for example, is determined for each color, and a binary bitmap is generated respectively.

However, in the printing apparatus described above, since prediction of the recording agent to be used is performed according to print data that is just about to be used for printing, that is, the bitmap in which the color-correction process, the halftone process etc. have been performed with respect to image data that has undergone resolution conversion in order to match the printer resolution. Therefore, much time will be spent for the processes of generating an enormous amount of data that configures the bitmap matching the printer resolution and the processes of predicting the usage amount of recording agent based on such a bitmap. This usage amount prediction is an unnecessary process in the original printing process. That is, if the usage amount of recording agent is less than the remaining amount of recording agent, then it is preferable that the process is performed in the shortest time as possible, since such a process will only cause a delay in printing speed.

SUMMARY OF THE INVENTION

The present invention has been made in view of the above problems, and an object thereof is to realize a printing apparatus, a computer-readable medium, and a printing method capable of performing prediction of a usage amount of a recording agent with respect to image data to be printed in a short amount of time.

A main invention is a printing apparatus as follows.

A printing apparatus comprises:

a print head for performing printing using a recording agent; and a usage amount prediction section for predicting, before printing is performed at a predetermined resolution based on image data using the print head, a usage amount of the recording agent to be used for the printing, wherein, upon predicting the usage amount, the usage amount prediction section uses data based on the image data and having a resolution lower than the predetermined resolution.

Other features of the present invention are made clear by the description below and the accompanying drawings.

BRIEF DESCRIPTION OF THE DRAWINGS

For complete understanding of the present invention and the advantages thereof, reference is to be made to the following description taken in conjunction with the accompanying drawings wherein:

FIG. 7 is a diagram for illustrating ink-density ratios for each print pattern;

DETAILED DESCRIPTION OF THE PREFERRED EMBODIMENTS

Figure 1:
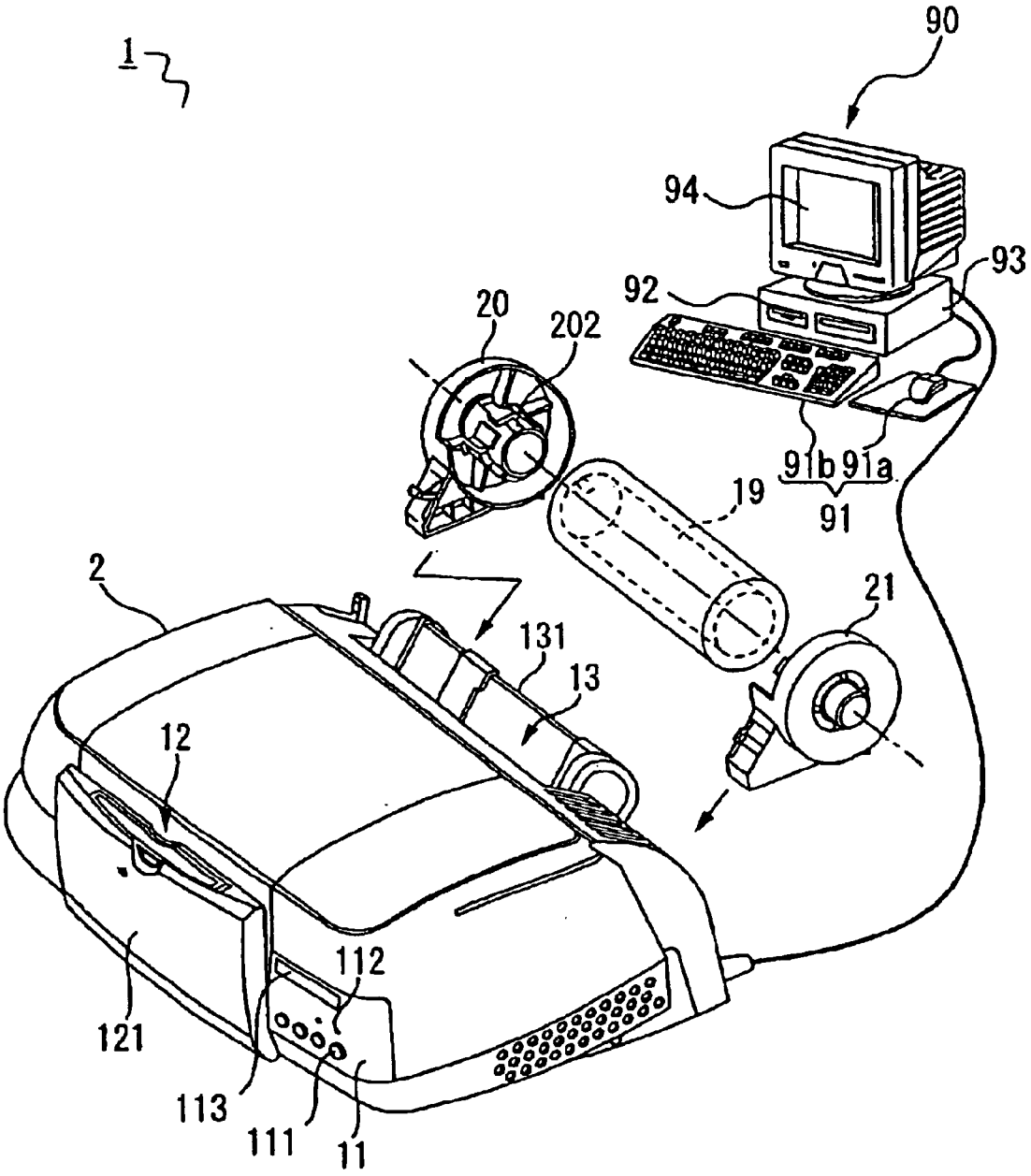
FIG. 1 is a diagram showing a schematic external view of a printing apparatus according to the present embodiment.

At least the following matters will be made clear by the description given in the section regarding the detailed explanation of the invention in the present specification.

A printing apparatus comprises:

a print head for performing printing using a recording agent; and a usage amount prediction section for predicting, before printing is performed at a predetermined resolution based on image data using the print head, a usage amount of the recording agent to be used for the printing, wherein, upon predicting the usage amount, the usage amount prediction section uses data based on the image data and having a resolution lower than the predetermined resolution.

According to such a printing apparatus, the amount of data used for predicting the usage amount will be smaller than in a case where prediction is made from data having the predetermined resolution. Therefore, it becomes possible to perform processes, such as to predict the usage amount or to subject the data used for prediction for the image data to processes such as a color-correction process and a halftone process, in a short amount of time. Here, a printing apparatus means a device for performing the process of predicting, before printing, the usage amount of the recording agent to be used for the printing using data having a resolution lower than the predetermined resolution, which process being a characteristic aspect of this invention. For example, a printer itself will be the printing apparatus when the above is performed according to processes in the printer alone, and a system in which a host and a printer are used in combination will be the printing apparatus when the above is performed as processes of a driver of the host connected to the printer.

In the printing apparatus, it is preferable that the usage amount prediction section predicts the usage amount of the recording agent using a usage amount of the recording agent obtained based on the data having low resolution and a conversion coefficient for converting this obtained usage amount of the recording agent into a usage amount corresponding to the predetermined resolution.

According to such a printing apparatus, it becomes possible to easily obtain, from the data having low resolution, the usage amount of the recoding agent when printing according to the predetermined resolution, and it becomes possible to predict the usage amount corresponding to the predetermined resolution even from a small amount of data.

In the printing apparatus, it is preferable that a plurality of the conversion coefficient are stored, each being associated with the resolution of the data used for prediction and the predetermined resolution.

According to such a printing apparatus, by setting each conversion coefficient so that it is associated with a combination of the low resolution for prediction and the predetermined resolution, it becomes possible to predict, in a short amount of time, the usage amount of the recording agent corresponding to a large number of resolutions.

In the printing apparatus, it is preferable that the printing is for forming dots with the recording agent; the data having low resolution is bitmap data indicating dots to be formed when printing at this resolution; and the usage amount of the recording agent obtained based on the data having low resolution is a usage amount of the recording agent used when forming dots that correspond to the bitmap data.

According to such a printing apparatus, the bitmap data used for predicting the usage amount indicates an amount of dots formed when printing at the low resolution corresponding to the data. Therefore, it becomes possible to easily obtain, with relative preciseness, the usage amount of the recording agent when forming dots corresponding to the bitmap data.

In the printing apparatus, it is preferable that the dots are in a plurality of sizes; and the usage amount of the recording agent obtained based on the data having low resolution is predicted based on a product of a number of dots counted separately for each of the sizes based on the bitmap data and an amount of the recording agent used for forming dots in each of the sizes.

According to such a printing apparatus, since the usage amount is predicted based on a product of a number of dots counted separately for each size of dots to be formed and an amount of the recording agent associated with each size, it becomes possible to predict the usage amount of the recording agent with high precision.

In the printing apparatus, it is preferable that the conversion coefficient is an average value of ratios, each being a ratio of a usage amount of the recording agent used per unit area when printing at the predetermined resolution to a usage amount of the recording agent used per unit area when printing at the low resolution for each of a plurality of different print methods.

According to such a printing apparatus, since a conversion coefficient made to correspond to different print methods is used, it becomes possible to predict an approximately suitable usage amount in case of performing printing according to any one of the print methods, and it becomes possible to predict a highly-reliable usage amount even when printing according to any one of the print methods.

In the printing apparatus, it is preferable that the apparatus has a black recording agent and a chromatic color recording agent, wherein the conversion coefficient is set separately for the black recording agent and the chromatic color recording agent.

In many cases, the black recording agent is used for printing texts, and in many cases, the chromatic color recording agent is used for printing, for example, natural images. The usage amount of recording agent used per unit area differs greatly between these texts and natural images. Therefore, according to the printing apparatus in which the conversion coefficient for the black recording agent and the conversion coefficient for the chromatic color recording agent are set separately, it becomes possible to predict a usage amount that is appropriate for the black recording agent and the chromatic color recording agent, respectively.

In the printing apparatus, it is preferable that the apparatus comprises notification means for notification of an event when an event to be notified to a user occurs; and remaining amount calculation means for calculating a remaining amount of the recording agent based on a usage amount of the recording agent that has been used for printing, wherein when the predicted usage amount and the remaining amount are compared and the remaining amount is smaller, an event indicative of such a fact is notified with the notification means.

According to such a printing apparatus, when a necessary amount of recording agent for printing the image data to be printed does not remain, it becomes possible to notify the user of an event indicative of such a fact. Therefore, printing will not be interrupted in the middle of printing, and therefore it becomes possible to prevent waste of recording agents, recording sheets, etc. and a waste of time for printing.

In the printing apparatus, it is preferable that the recording agent is ink; and the printing apparatus is an inkjet printer.

Further, a computer-readable medium for controlling a printing apparatus, comprises the following code:

a code for predicting, before printing is performed at a predetermined resolution based on image data using a recording agent, a usage amount of the recording agent to be used for the printing using data based on the image data and having a resolution lower than the predetermined resolution.

Further, a printing method comprises the following steps:

a step of obtaining image data; and a step of predicting, before printing is performed at a predetermined resolution based on the image data using a recording agent, a usage amount of the recording agent to be used for the printing, wherein, upon predicting the usage amount, data based on the image data and having a resolution lower than the predetermined resolution is used.

Schematic Configuration of Printing Apparatus

Description will be made mainly of an outer schematic configuration of a printing apparatus according to the present embodiment with reference to FIG. 1. FIG. 1 is a diagram showing a schematic configuration of a printing apparatus according to the present embodiment.

In FIG. 1, a computer system 1 in which a color inkjet printer (hereinafter referred to as printer) 2 and a host computer 90 are connected is shown as an example of a printing apparatus. The computer system 1, serving as the printing apparatus, is configured of: the host computer 90 that comprises a main computer unit 93, a display 94, an input device 91 such as a mouse 91*a* and a keyboard 91*b*, and a reading device 92; and the printer 2. Note that the printer 2 has a roll paper unit 19 that is detachably attached thereto.

The printer 2 is a printer capable of outputting color images. It uses, for example, four colors—cyan (C), magenta (M), yellow (Y), and black (K)—of color ink as a recording agent, and is an inkjet-type printer that forms an image by ejecting the color ink onto an object subjected to printing, such as the roll paper, and forming dots. Note that, in addition to the four colors described above, it is possible to use light cyan (pale cyan, LC), light magenta (pale magenta, LM), and dark yellow (dim yellow, DY) as the color ink.

As shown in FIG. 1, the printer 2 has a paper supply section 13 on its back surface, and is structured to discharge the object subjected to printing, such as printing paper having been supplied from the paper supply section, from its front surface. The front surface of the printer 2 is provided with an operation panel 11 and a paper discharge section 12, and a buzzer 70 (FIG. 3), which serves as notification means to a user, is provided inside.

The operation panel 11 is provided with various operation buttons 111, display lamps 112 and a displaying display 113 for notifying the user of various kinds of information. Further, the paper discharge section 12 is provided with a paper discharge tray 121 that covers the paper discharge opening when it is not in use. The paper supply section 13 is provided with a paper supply holder 131 for holding cut sheets (not shown) and roll paper unit holders 20, 21 for holding the roll paper unit 19.

Inner Configuration of Printer 2

Figure 2:
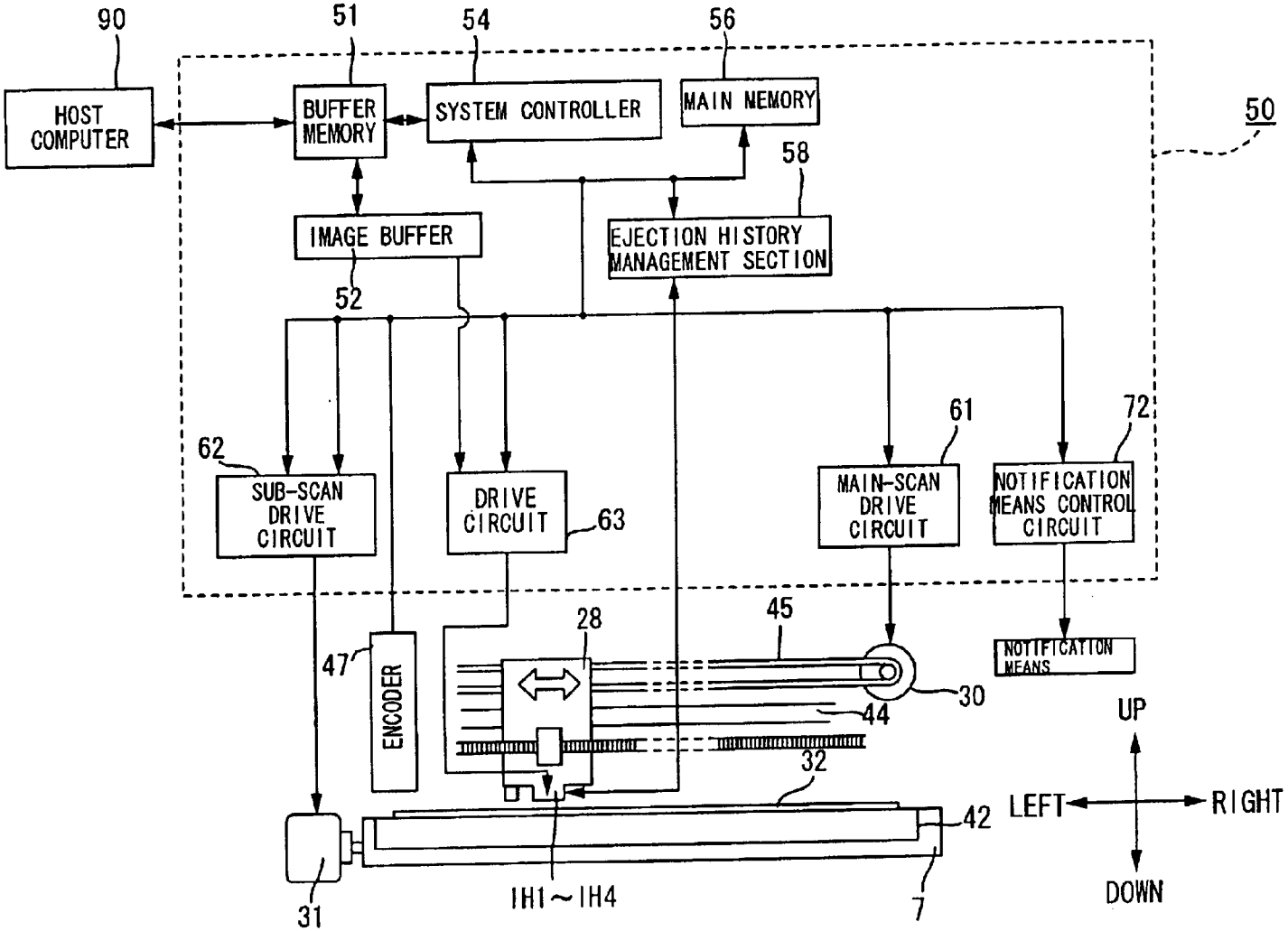
FIG. 2 is a diagram showing an inner configuration of a printer 2 according to the present embodiment.

Next, with reference to FIG. 2, an inner configuration of the printer 2 will be described. FIG. 2 is a diagram showing an inner configuration of the printer 2 according to the present embodiment.

As shown in the figure, the printer 2 has a mechanism for driving print heads 22, 24, 25, 26, which are mounted on a carriage 28, to eject ink and form dots, a mechanism for making the carriage 28 move back and forth in the axial direction of a platen 42 using a carriage motor 30, a mechanism for carrying print roll paper 32 supplied from the roll paper unit 19 by the paper feed motor 31, and a control circuit 50.

The mechanism for making the carriage 28 move back and forth in the axial direction of the platen 42 is configured of, for example: a slide shaft 44 slidably holding the carriage 28 and provided above and in parallel to the axis of the platen 42; and a pulley with an endless drive belt 45 provided stretched in between the carriage motor 30 and itself.

The mechanism for carrying the print roll paper 32 supplied from the roll paper unit 19 has: the platen 42; the paper feed motor 31 for carrying the print roll paper 32; a carry roller 7 that is made to rotate by the paper feed motor 31; and an encoder 47 for detecting a carry amount of the print roll paper 32.

When print command signals are input from the operation panel 11 of the printer and/or the host computer 90 connected to the printer, the control circuit 50 appropriately controls the movement of the paper feed motor 31, the carriage motor 30, and the print heads 22, 24, 25, 26. The print roll paper 32 of the roll paper unit 19, which is held by the roll paper unit holders 20, 21 of the printer 2, is guided above the platen 42 and is carried by the carry roller 7.

To the carriage 28 are fixed the print heads 22, 24, 25, 26 each having a multitude of nozzles, and a cartridge mounting section that is integrally provided with the print heads 22, 24, 25, 26. An ink cartridge INC1 and an ink cartridge INC2 are mounted on this cartridge mounting section. The ink cartridge INC2 contains black (K) ink, and the ink cartridge INC1 contains other ink, that is, the inks in three colors of cyan (C), magenta (M), and yellow (Y). Inks of light cyan (LC), light magenta (LM), dark yellow (DY) may also be contained, as already described above.

Inner Configuration of Control Circuit 50

Figure 3:
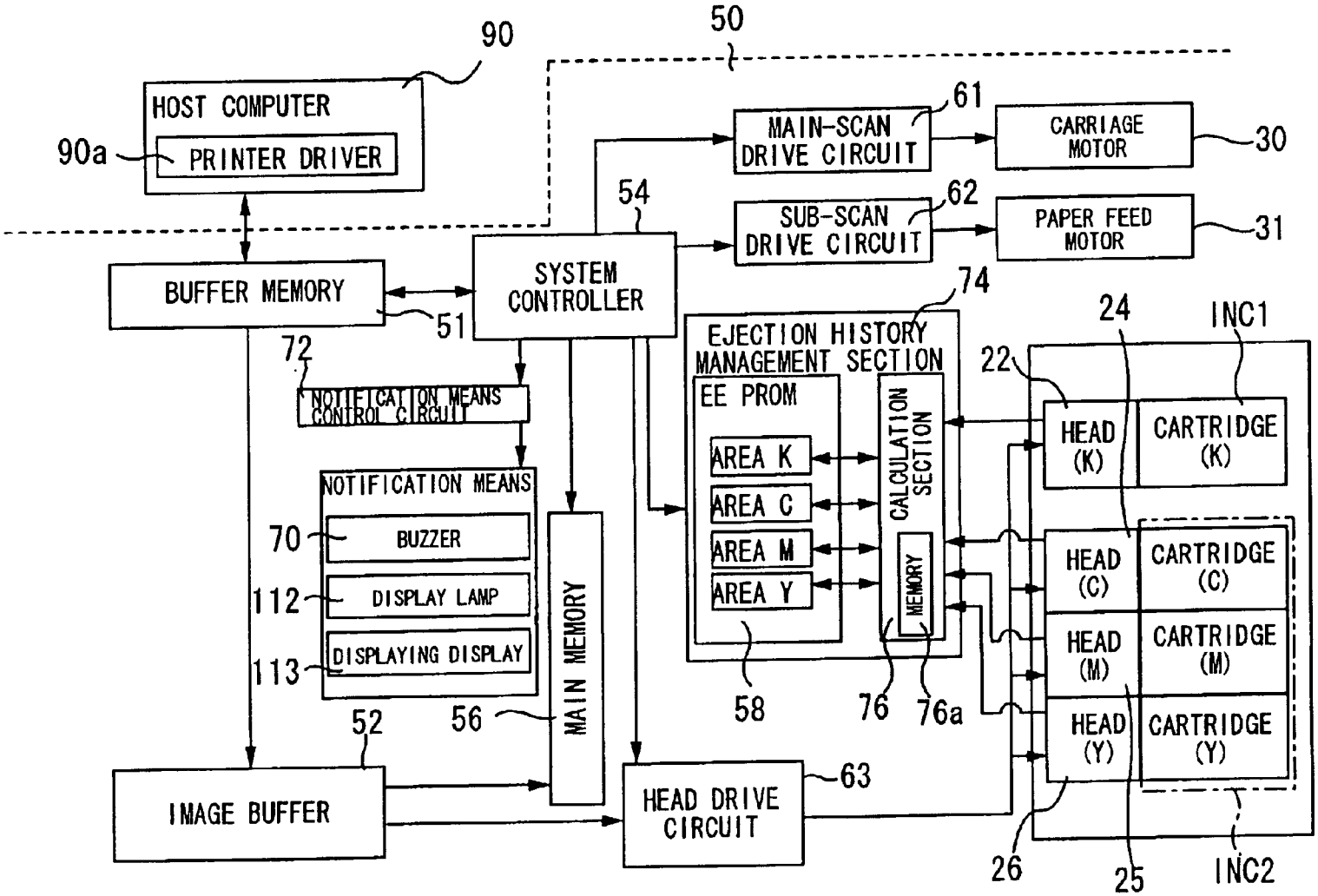
FIG. 3 is a block diagram showing an inner configuration of a control circuit 50 of the printer 2 according to the present embodiment.

Next, with reference to FIG. 3, an inner configuration of a control circuit 50 of the printer 2 will be described. FIG. 3 is a block diagram showing an inner configuration of a control circuit 50 of the printer 2 according to the present embodiment.

As shown in FIG. 3, inside the control circuit 50 are provided: a buffer memory 51 for receiving signals supplied from the host computer 90 that has the display 94 as display means; an image buffer 52 for storing print data; a system controller 54 for controlling the overall operation of the printer 2; and a main memory 56. Further, to the system controller 54 are connected: a main-scan drive circuit 61 for driving the carriage motor 30; a sub-scan drive circuit 62 for driving the paper feed motor 31; a head drive circuit 63 for driving the print heads 22, 24, 25, 26; an ejection history management section 74 for calculating a consumption amount of ink; and a notification means control circuit 72 for controlling the above-mentioned display lamps 112, the displaying display 113, and the buzzer 70 which serve as notification means to the user.

The ejection history management section 74, which serves as remaining amount calculation means, is provided with a calculation section 76 for calculating the consumption amount and remaining amount of ink according to drive signals of the print heads, and an EEPROM 58 for storing the calculated remaining amount of ink. For example, the print head 22 mounted on the carriage 28 for ejecting black ink is configured to count the consumption amount of ink for each type of dot when ink is consumed through, for example, printing or head cleaning, and to store the obtained remaining amount of ink in area K of the EEPROM 58 for the black ink. In the same way, the print head 24 for ejecting cyan ink, the print head 25 for ejecting magenta ink, and the print head 26 for ejecting yellow ink, which are mounted on the carriage 28, are configured to separately store the remaining amount of ink in the areas C, M, Y of the EEPROM 58 for inks of each color, respectively. Stored contents will not be lost even when the main power of the printer is turned OFF.

The print data transferred from the host computer 90 is temporarily stored in the buffer memory 51. In the printer 2, the system controller 54 reads necessary information from the print data in the buffer memory 51 and, in according therewith, sends control signals to the main-scan drive circuit 61, the sub-scan drive circuit 62, and the head drive circuit 63.

To the image buffer 52 is stored print data for a plurality of color components received by the buffer memory 51. The head drive circuit 63 reads out, from the image buffer 52, the print data for each color component according to the control signal from the system controller 54 and, in accordance therewith, drives the nozzle arrays for each color provided on the print heads 22, 24, 25, 26.

Operation of Printing Apparatus

The computer system 1, serving as the printing apparatus, is made to operate according to print commands input from the host computer 90 by the user.

<<<Outline of Printing Process>>>

Figure 4:
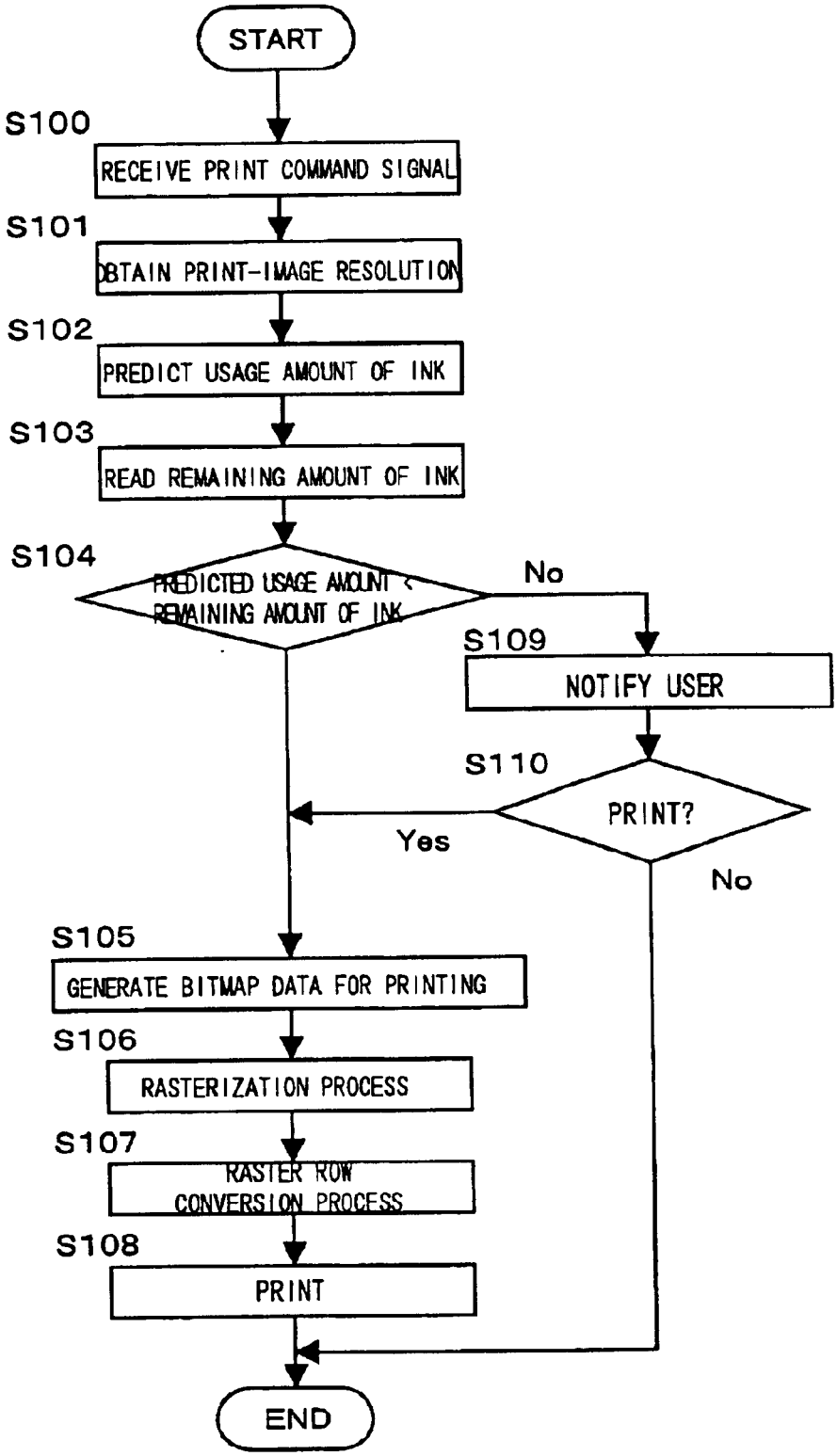
FIG. 4 is a flowchart showing an outline of a printing process of the present embodiment.

FIG. 4 is a flowchart showing an outline of a printing process performed by a computer system in the present embodiment.

When image data to be printed is designated by the user and a print command is input, along with print information, from the host computer 90 (S100), the printer driver 90*a* in the host computer 90 reads the print information. The print information includes, for example, the type of printing paper, such as glossy paper and plain paper, and print mode, such as high-resolution mode and fast mode, that have been designated by the user. The type of printing paper and the print mode being designated, the resolution in the main-scan and sub-scan directions for the image to be printed and the print method, such as a method in which the object is fed in units of band-like printed patterns and the various kinds of interlace methods, are determined. For example, if the user designates plain paper and designates the fast mode as the print mode, then an image in which the resolution in the main-scan and sub-scan directions is both of a 360-dpi resolution will be printed according to the band-feed method. If glossy paper is designated and the high-resolution mode is designated, an image with a resolution of 1440 dpi in the main-scan direction and 720 dpi in the sub-scan direction will be printed according to a predetermined interlace method.

Here, description will be made of an example in which glossy paper is designated as the type of printing paper and the high-resolution mode is designated as the print mode, as print information.

When information about the print-image resolution is obtained from the print information having been input (S101), the designated image data is supplied to the printer driver 90*a*, and a prediction process, which is for predicting the usage amount of ink that will be used in printing that image data, is executed (S102). This prediction process will be described later.

When the usage amount of ink for each color is predicted according to the prediction process, the data about the remaining amount of ink for each color, which is stored in the EEPROM 58 of the printer 2, is obtained (S103) and the remaining-amount data and the predicted usage amount of ink is compared (S104). If the remaining amount is larger, then normal printing operation is performed. That is, the designated image data (image signal that has been read) is supplied to the printer driver 90*a*, the data is divided into the three primary colors, R (red), G (green), and B (blue), with the rasterizer that the printer driver 90*a* comprises, and RGB bitmap data for which rasterization has been performed for each color is obtained. The resolution of the obtained RGB bitmap data is converted so that it matches the resolution for output with the printer, that is, the resolution of 1440 dpi in the main-scan direction and 720 dpi in the sub-scan direction. For example, if the image data is bitmap data that has been read at a resolution of 360 dpi in both the main-scan direction and the sub-scan directions, then a resolution conversion for generating data for interpolation between each data in the main-scan direction and the sub-scan direction is performed. The resolution-converted RGB bitmap data is subjected to a color-correction process by the color-correction module so that the data matches the colors for printing, and is converted into CMYK bitmap data for printing in K (black), C (cyan), M (magenta), and Y (yellow). Further, after dividing C and M of the CMYK bitmap data into C, c and M, m using a dark/light ink division table, a halftone process according to, for example, the dither method or the error diffusion method is performed by the halftone module. In this way, arrangement on the bitmap, for example, is determined for each color, and binary bitmap data is generated respectively (S105).

This binary bitmap data is sent out to the printer 2 along with control signals. In the printer 2, the binary bitmap data is stored in the buffer memory 51, and, according to processing in the system controller 54, the data is subjected to a rasterizing process and a raster-row conversion process so that it matches the designated print method and is loaded into the image buffer (S106, S107). The system controller 54 controls the main-scan drive circuit 61, the sub-scan drive circuit 62, and the head drive circuit 63 according to the control signals of the host computer and makes the heads for each color eject dots of a predetermined type according to the data in the image buffer (S108). Here, the system controller 54 measures the usage amount of ejected ink according to head drive signals of the head drive circuit 63. The ink measurement method will be described later.

On the other hand, if, as a result of comparing the data about the remaining amount of ink for each color stored in the EEPROM 58 of the printer 2 and the predicted usage amount of ink, the remaining amount is smaller, such a fact and a message urging to quit printing or urging to change the print method is displayed on the display 94 of the host computer 90 and/or the displaying display 113 of the printer 2, and/or a notification is made to the user using, for example, the display lamps 112 or the buzzer 70 of the printer 2 (S109, S110). When a command designating a print method and instructing to continue the printing process is input by the user in response to this notification, the printing process is executed according to the designated print method (S105 through S108).

<<<Usage Amount Prediction Process About Ink Used for Printing>>>

Figure 5:
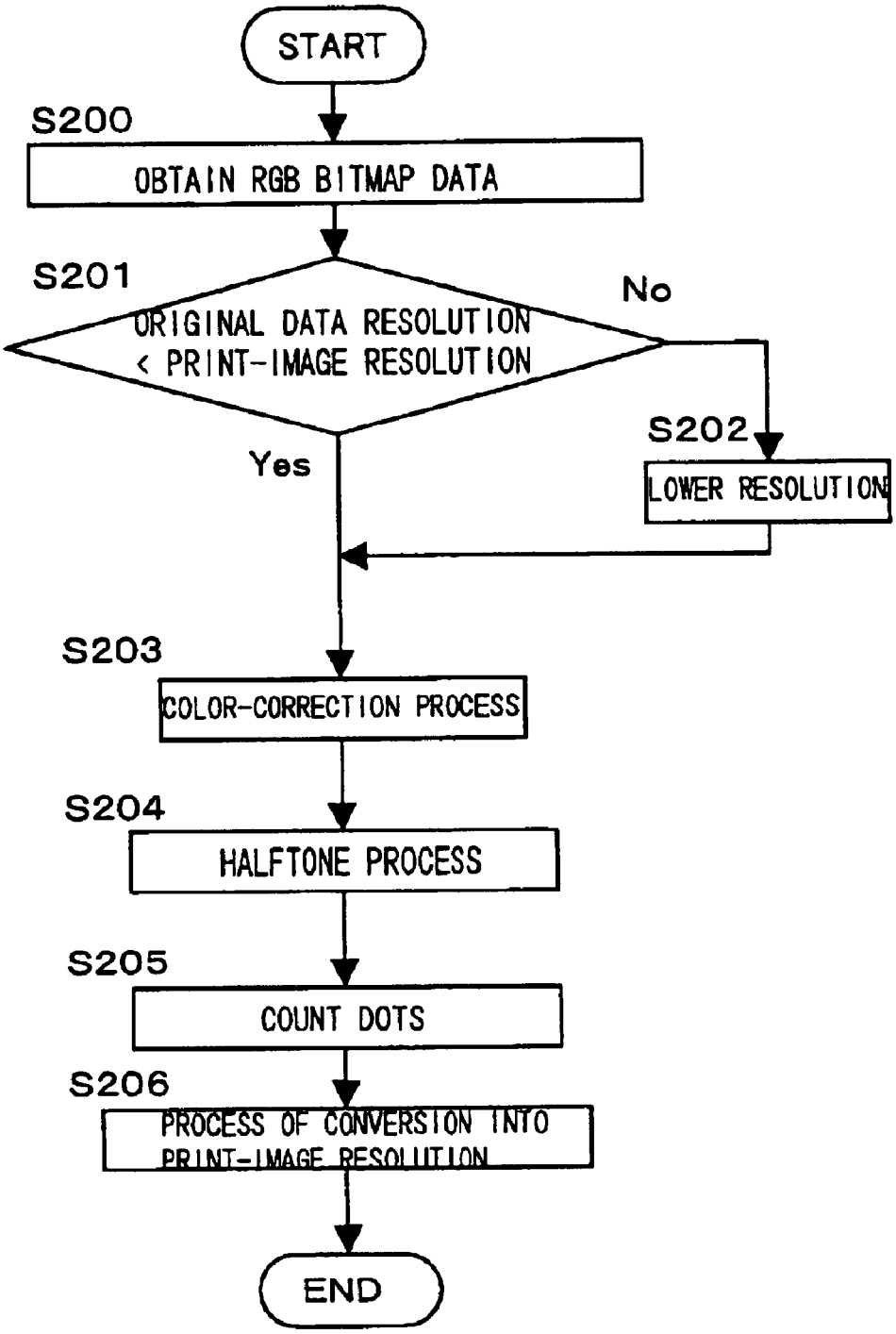
FIG. 5 is a flowchart showing an ink usage amount prediction process of the present embodiment.

FIG. 5 is a flowchart showing an ink usage amount prediction process performed by the computer system in the present embodiment. The usage amount prediction process described below is executed by the printer driver 90*a* provided in the host computer 90. Therefore, the printer driver 90*a* has a function as the usage amount prediction section. Further, in, for example, the memory of the host computer 90, codes for executing each of the following processes are stored.

In the prediction process for predicting the usage amount of ink, prediction bitmap data for predicting the usage amount of ink is used.

In the prediction process, first, the designated image data is divided into the three primary colors, R (red), G (green), and B (blue), with the rasterizer of the printer driver 90*a* to obtain RGB bitmap data (S200).

Next, the resolution of the obtained RGB bitmap data and the print-image resolution (refer to FIG. 4, S102) obtained by the above-mentioned printing process are compared (S201).

Here, if the resolution of the designated image to be printed (hereinafter also referred to as "original data resolution") is higher than the print-image resolution, the resolution is lowered by carrying out a process of, for example, thinning out data in order to make the resolution of the prediction bitmap data lower than the print-image resolution (S202).

As described above, in the present embodiment, since the original data resolution is 360 dpi in both the main-scan direction and the sub-scan direction, the resolution of the data is not lowered. However, it is possible to create data with a lower resolution.

The low-resolution RGB bitmap data so obtained is subjected to the color-correction process by the color-correction module according to the method described above and is converted into CMYK bitmap data for printing (S203). Further, after the data is subjected to the dark/light ink division, the halftone process according to, for example, the dither method or the error diffusion method is performed by the halftone module (S204). Accordingly, multi-value bitmap data having a resolution of 360 dpi in both the main-scan direction and the sub-scan direction is created for each color.

In this bitmap data, the sizes of dots to be formed are indicated as dots having three types of sizes, namely, large dots, medium dots, and small dots, according to the arrangement on the bitmap. In the present embodiment, this bitmap data is used as the prediction bitmap data for predicting the usage amount of ink.

According to processing in the printer driver 90*a*, the numbers of large dots, medium dots, and small dots that are present in the bitmap data for each color are counted, and ink weight values corresponding to each of the sizes of the dots are accumulatively added up and stored in a memory (S205). For example, when the weight value of ink used for forming small dots is 100 ng, the weight value of ink used for forming medium dots is 200 ng, and the weight value of ink used for forming large dots is 300 ng, a number of dots counted separately for each size and each weight value corresponding to each size are multiplied. Further, the usage amounts of ink for each of the three types of dots are added up, and the usage amount of ink corresponding to a resolution of 360 dpi is calculated and stored in a memory.

A conversion coefficient α described later is multiplied to this usage amount of ink corresponding to the resolution of 360 dpi to thereby convert the amount into a usage amount of ink equivalent to the print-image resolution, i.e., a resolution of 1440 dpi in the main-scan direction and 720 dpi in the sub-scan direction and to calculate the prediction value of the usage amount of ink (S206).

The conversion coefficient a is a coefficient for converting the usage amount of the recording agent obtained based on the data having low resolution and the obtained usage amount of recording agent into a usage amount corresponding to the print-image resolution. Each coefficient is associated with each of a plurality of original data resolutions and the print-image resolution capable of being printed by the printer 2. A plurality of conversion coefficients α corresponding to each of the resolutions are stored in the memory of the host computer 90.

The conversion coefficient a indicates a ratio of an amount of ink ejected per unit area (hereinafter referred to as ink density) when a same image is printed at different resolutions, i.e., a resolution that could be an original data resolution and a resolution that could be a print-image resolution, and is expressed according to the following equation:

$$\text{CONVERSION COEFFICIENT } \alpha = \frac{\text{INK DENSITY WITH RESPECT TO PRINT-IMAGE RESOLUTION}}{\text{INK DENSITY WITH RESPECT TO ORIGINAL DATA RESOLUTION}}$$

By the way, the ink density is a value that differs according to the print method even if printing is performed at a same resolution. For example, in a method where each raster is sequentially printed from the leading end of the printing paper, ink is ejected, before the ink of dots that form an adjacent raster in the paper-feed direction dries, next to the wet ink. Therefore, the amount of ink ejected is set to a small amount in order to prevent ink blotting. On the other hand, in case of printing a plurality of rasters with spaces therebetween and printing adjacent rasters between the previous rasters after an appropriate amount of time has passed, the amount of ink ejected is set to a larger amount since a possibility that blotting will occur is low.

In view of the above, in order to prevent the predicted usage amount from departing greatly from the usage amount of ink actually used when printing is performed according to one of the print methods, the coefficient is set according to an average ink density value αAve obtained when printing is performed according to a plurality of print methods, even for one conversion coefficient associated with a certain original data resolution and a certain print-image resolution.

Figure 6:
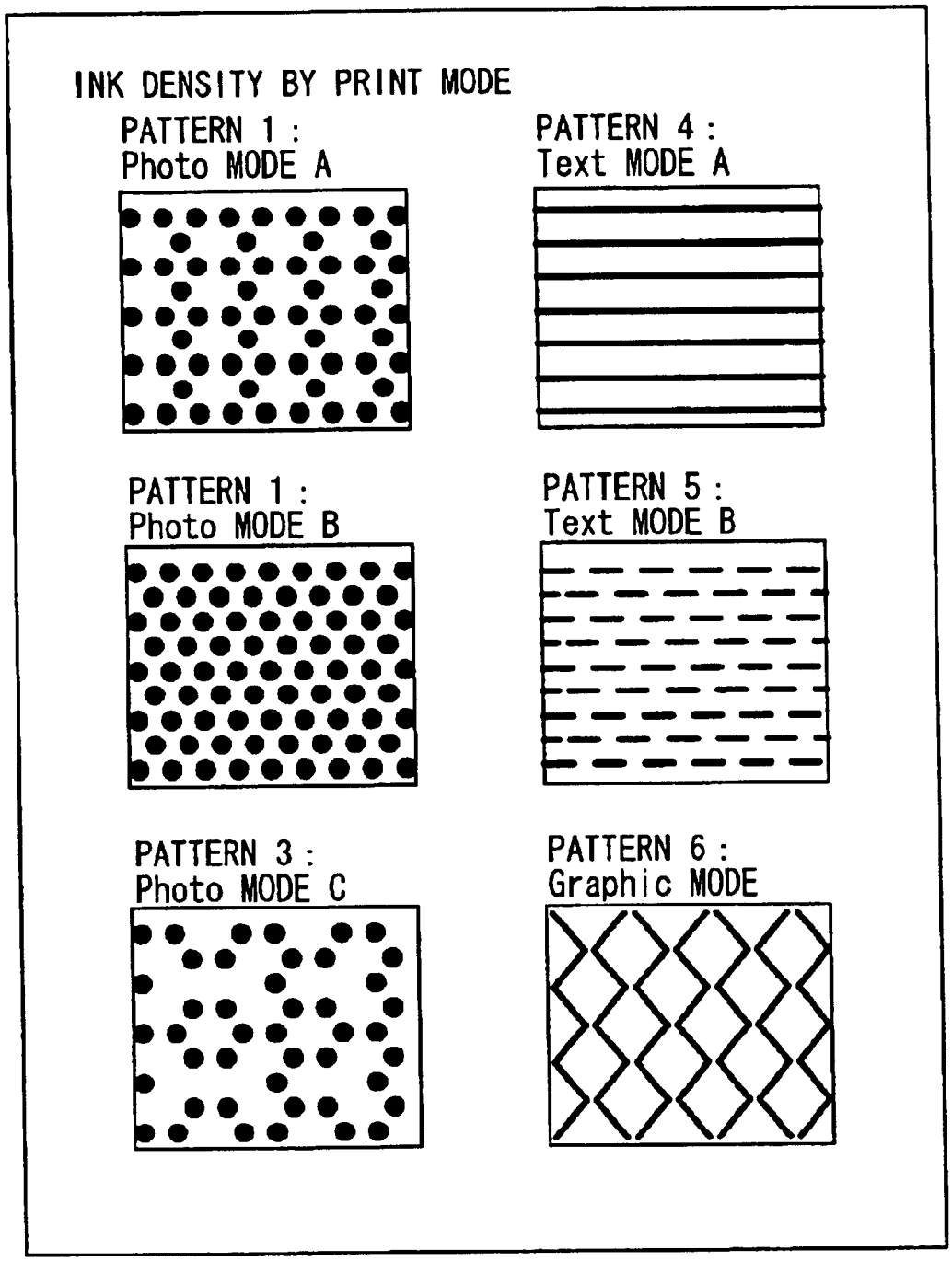
FIG. 6 is a conceptual diagram showing print patterns for obtaining a conversion coefficient that suits a plurality of print modes and print modes.

For example, description will be made for a case where printing is performed according to a resolution of 1440 dpi in the main-scan direction and 720 dpi in the sub-scan direction. FIG. 6 is a conceptual diagram showing print patterns for obtaining a conversion coefficient that suits a plurality of print modes and print methods. FIG. 7 is a diagram for illustrating ink-density ratios for each print pattern.

As shown in FIG. 6, the computer system 1 has three print modes, the Photo mode, the Text mode, and the Graphic mode. With those print modes, it is possible to print six print patterns, including print patterns according to different print methods. The ink density for printing each of these print patterns is shown in FIG. 7.

The conversion coefficient a in this case will be the average value αAve that is obtained by adding the ink-density ratios for pattern 1 through pattern 6, that is, all of the ratios each of which being a ratio of the ink density when printing at the print-image resolution (1440 dpi×720 dpi) to the ink density when printing at the original data resolution (360 dpi×360 dpi), and then dividing the sum by the number of print patterns, i.e., six.

Further, a color printer has black ink as well as inks of chromatic colors, such as cyan ink, magenta ink, and yellow ink. Since, in many cases, the black ink and the chromatic color inks are used for different print objects, the printer has separate conversion coefficients α suiting each. That is, in many cases, black ink is used for printing texts, and in many cases, chromatic color inks are used for printing, for example, natural images. Since the usage amount of ink used per unit area differs greatly between these texts and natural images, a conversion coefficient for black ink and a conversion coefficient for chromatic color inks are set separately to enhance prediction precision.

<<<Ink Usage Amount Measurement Process During Printing Operation>>>

Figure 8:
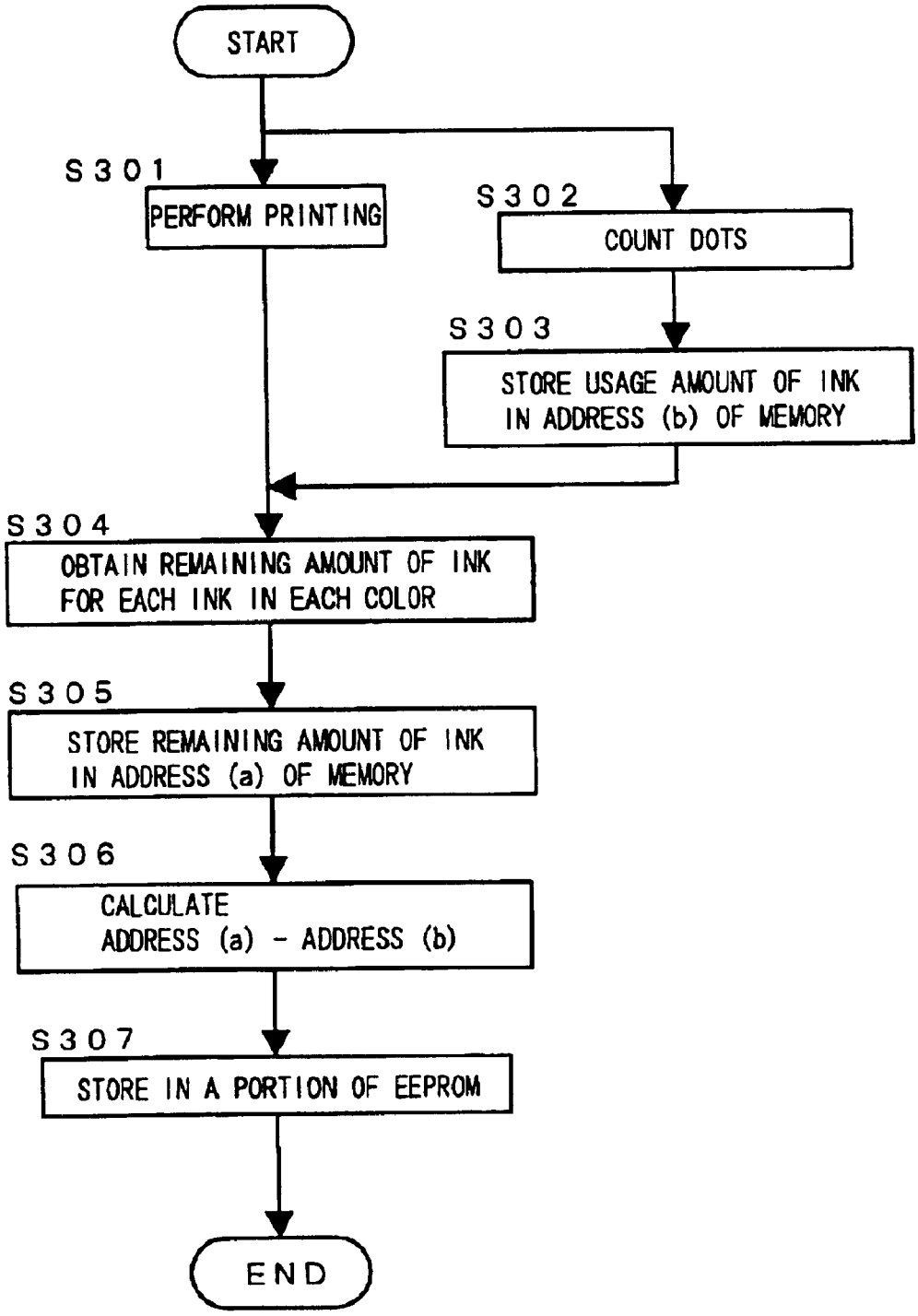
FIG. 8 is a flowchart for explaining a process of obtaining a remaining amount of ink of the present embodiment.

FIG. 8 is a flowchart showing a process of measuring the usage amount of ink performed by the computer system in the present embodiment.

The process of measuring the usage amount of ink consumed during the printing operation is performed by the calculation section of the ejection history management section 74 of the printer 2 according to head drive signals of the head drive circuit 63, as described above. The numbers of dots printed for each color of ink are counted (S302), and the weight of ink corresponding to the counted value is stored in address (b) of the memory 76*a* that the calculation section 76 has (S303).

As described above, the printer 2 of the present embodiment has three types of dot sizes, i.e., large dots, medium dots, and small dots, according to the image data. Therefore, the weight of ink consumed for one printed dot differs depending on which type of dot it is. That is, since the weight of each dot is set so that the weight value of ink used for forming small dots is 100 ng, the weight value of ink used for forming medium dots is 200 ng, and the weight value of ink used for forming large dots is 300 ng, a value obtained by multiplying 100 ng to a total count value, in which one count is made for one small dot, two counts are made for one medium dot, and three counts are made for one large dot, is stored in address (b) of the memory 76*a* as the usage amount of ink.

Then, as for the remaining amount of ink, after performing the printing process (S301), the remaining amount of ink for the inks of each color prior to performing the printing process is read by the calculation section 76 of the ejection history management section 74 from the EEPROM 58 (S304) and stored in address (a) of the memory in the calculation section 76 (S305). The calculation section 76 subtracts the value stored in address (b) from the value stored in address (a) (S306). The value obtained by subtraction is stored, as the remaining amount of ink after printing, in a predetermined storage device in a state where it can be referred to whenever necessary. For example, by writing the value back in a portion of the areas in the EEPROM 58 allocated to each color, the value will be saved even after the main power of the printer is turned OFF (S307).

Other Embodiments

Above, description was made of a printing apparatus and so on according to the present invention based on one embodiment thereof. However, the above-mentioned embodiment of the invention is for facilitating understanding of the present invention and is not for limiting the present invention. It is without saying that the present invention may be altered and/or modified without departing from the scope thereof, and that the present invention includes its equivalents and the like.

Figure 9:
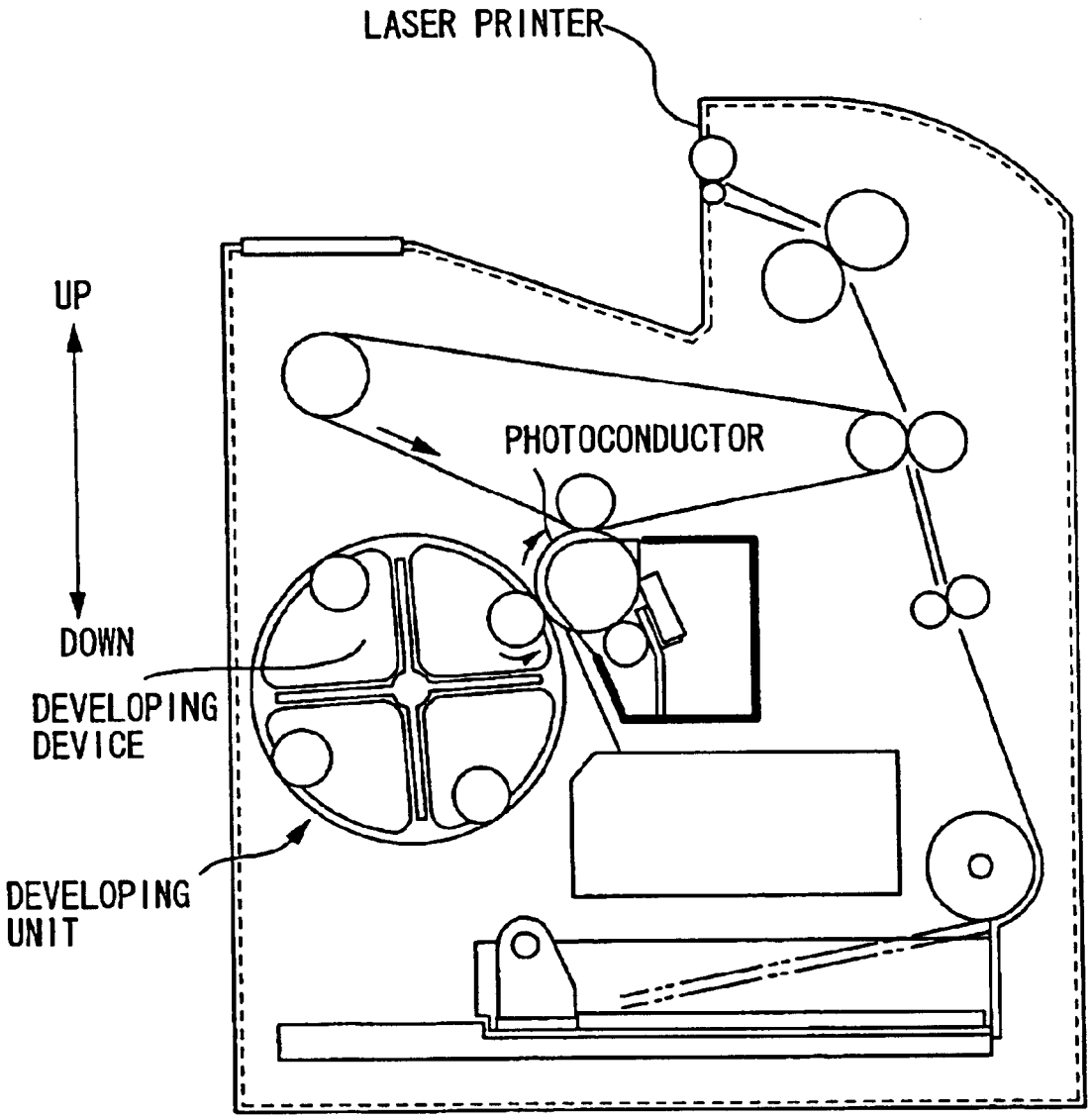
FIG. 9 is a section view showing a laser printer applicable as a printing apparatus of the present invention.

Further, in the present embodiment, an example was given in which the printer is an inkjet printer and ink is used as a recording agent. However, the recording agent is not limited to ink, but can be toner that is used in laser printers such as the one shown in FIG. 9.

Note that, in the description given above, an example was described of a configuration in which a computer system, where a printer 2 is connected to a host computer 90, is taken as a printing apparatus. However, it is not limited to the above. For example, the printer may be used alone if the printer 2 is configured to be capable of converting designated image data into CMYK bitmap data, which is to be the print data, and capable of predicting the usage amount of ink. In this case, the printer 2 may be configured to have, for example, a display section for making various kinds of displaying, and a recording media attach/detach section for attachment/detachment of a recording medium on which image data taken by, for example, a digital camera is recorded.

According to the present embodiment, it becomes possible to realize a printing apparatus, a computer-readable medium, and a printing method capable of performing, in a short amount of time, prediction of a usage amount of a recording agent with respect to image data to be printed.

What is claimed is:

1. A printing apparatus comprising:

a print head for performing printing using a recording agent; and a usage amount prediction section for predicting, before printing is performed at a predetermined resolution based on image data using said print head, a usage amount of the recording agent to be used for said printing, wherein, upon predicting said usage amount, said usage amount prediction section uses data based on said image data and having a resolution lower than said predetermined resolution.

2. A printing apparatus according to claim 1 wherein said usage amount prediction section predicts said usage amount of the recording agent using a usage amount of the recording agent obtained based on said data having low resolution and a conversion coefficient for converting this obtained usage amount of the recording agent into a usage amount corresponding to said predetermined resolution.

3. A printing apparatus according to claim 2 wherein a plurality of said conversion coefficient are stored, each being associated with the resolution of said data used for prediction and said predetermined resolution.

4. A printing apparatus according to claim 2 wherein:

said printing is for forming dots with said recording agent;

said data having low resolution is bitmap data indicating dots to be formed when printing at this resolution; and said usage amount of the recording agent obtained based on said data having low resolution is a usage amount of the recording agent used when forming dots that correspond to said bitmap data.

5. A printing apparatus according to claim 4 wherein:

said dots are in a plurality of sizes; and said usage amount of the recording agent obtained based on said data having low resolution is predicted based on a product of a number of dots counted separately for each of said sizes based on said bitmap data and an amount of the recording agent used for forming dots in each of said sizes.

6. A printing apparatus according to claim 2 wherein said conversion coefficient is an average value of ratios, each being a ratio of a usage amount of the recording agent used per unit area when printing at said predetermined resolution to a usage amount of the recording agent used per unit area when printing at said low resolution for each of a plurality of different print methods.

7. A printing apparatus according to claim 2 having a black recording agent and a chromatic color recording agent, wherein said conversion coefficient is set separately for said black recording agent and said chromatic color recording agent.

8. A printing apparatus according to claim 1 comprising:

notification means for notification of an event when an event to be notified to a user occurs; and remaining amount calculation means for calculating a remaining amount of the recording agent based on a usage amount of the recording agent that has been used for printing, wherein when said predicted usage amount and said remaining amount are compared and said remaining amount is smaller, an event indicative of such a fact is notified with said notification means.

9. A printing apparatus according to claim 1 wherein:

said recording agent is ink; and said printing apparatus is an inkjet printer.

10. A computer-readable medium for controlling a printing apparatus, comprising the following code:

a code for predicting, before printing is performed at a predetermined resolution based on image data using a recording agent, a usage amount of the recording agent to be used for said printing using data based on said image data and having a resolution lower than said predetermined resolution.

11. A printing method comprising the following steps:

a step of obtaining image data; and a step of predicting, before printing is performed at a predetermined resolution based on said image data using a recording agent, a usage amount of the recording agent to be used for said printing, wherein, upon predicting said usage amount, data based on said image data and having a resolution lower than said predetermined resolution is used.

* * * * *